United States Patent [19]

Dodge et al.

[11] Patent Number: 4,841,650

[45] Date of Patent: Jun. 27, 1989

[54] SKI BOOT

[75] Inventors: David Dodge, Shelburne, Vt.; Jean-Francois Lanvers, Park City, Utah

[73] Assignee: Lange International S.A., Switzerland

[21] Appl. No.: 150,743

[22] Filed: Feb. 1, 1988

[30] Foreign Application Priority Data

Feb. 4, 1987 [CH] Switzerland ..... 391/87

[51] Int. Cl.[4] ..... A43B 5/04

[52] U.S. Cl. ..... 36/119; 36/120

[58] Field of Search ..... 36/117–121, 36/88, 93, 58.5

[56] References Cited

U.S. PATENT DOCUMENTS

| | | | |
|---|---|---|---|
| 4,510,703 | 4/1985 | Eiteljorg | 36/119 |
| 4,539,763 | 9/1985 | Walkhoff | 36/120 |
| 4,565,017 | 1/1986 | Ottieri | 36/117 |
| 4,693,020 | 9/1987 | Salas et al. | 36/117 |

FOREIGN PATENT DOCUMENTS

| | | | |
|---|---|---|---|
| 0172159 | 2/1986 | European Pat. Off. | 36/117 |
| 0182778 | 5/1986 | European Pat. Off. | 36/117 |
| 0249115 | 12/1987 | European Pat. Off. | 36/117 |
| 2555418 | 5/1985 | France | 36/117 |
| 2556187 | 6/1985 | France | 36/117 |
| 2576192 | 7/1986 | France | 36/119 |

OTHER PUBLICATIONS

WO87/05474, 9/1987, WIPO (Koflach).

*Primary Examiner*—James Kee Chi

*Attorney, Agent, or Firm*—Kane, Dalsimer, Sullivan, Kurucz, Levy, Eisele and Richard

[57] ABSTRACT

This ski boot of semi-rigid synthetic material has a lower portion (3) comprising the sole and at least one pair of opposite flaps (11, 12, 13, 14) controlled by means of a foot-tightening system. The flaps are covered by a vamp (5) attached or not to the front quarter (4) of the boot shaft. This front quarter (4) is allowed to bend forwards with respect to the vamp (5) and bears against a resilient member (29) mounted on or under the vamp so as to provide an elastic flexion of which the elasticity is adjustable. With this construction the skier's foot is properly held in the boot without impairing the boot tightness.

17 Claims, 7 Drawing Sheets

SKI BOOT

BACKGROUND OF THE INVENTION

1. Field of the Invention

The present invention relates to ski boots and has specific reference to a ski boot comprising a shell of semi-rigid material consisting of a lower portion including the sole and surrounding the skier's foot and of a shaft made of two sections, namely a front quarter and back quarter; and resilient means for counteracting the forward flexion of the front quarter of the shaft, and foot holding means inside the shell.

A ski boot of this type, commonly referred to as a rear-entry boot due to the possibility of tilting the rear quarter of the shaft backwards, is disclosed for example in U.S. Pat. No. 4,160,332. This boot consists of a rigid shell surrounding the skier's foot and has fixed volumetric dimensions in contrast to the so-called variable-volume boot in which the upper can be tightened for properly fitting on the foot. Since the volume of this shell portion cannot be reduced, the foot is held by means of an internal device comprising on the one hand a bearing plate having the configuration of the insteps and secured to the vamp or to the inner slipper, and on the other hand cable means permitting of exerting a tractive effort in a diagonal direction on said bearing plate towards the heel, and thus properly nest the skier's heel in the heel cavity of the boot. Under these conditions, the proper fitting of the skier's foot depends almost completely on the proper fitting of the heel in its cavity. The front portion of the foot too is obviously not held in the case of a narrow foot, so that the play between the foot and the inner space of the boot may become excessive and render ski practice more difficult.

Now this problem is eliminated in ski boots of which the vamp is provided with flaps adapted to be tightened by means of buckles, but boots of this type, though very popular before the advent of shell boots, can scarsely prevent the ingress of snow and water.

2. Summary of the Invention

It is the primary object of the present invention to provide a shell-type ski boot having a variable inner volume, that is, the possibility of adapting the inner transverse dimensions of the boot to the foot dimensions and consequently of warranting a satisfactory fit of the foot in the boot.

For this purpose, the ski boot according to the present invention is characterized in that the foot-covering portion of the shell consists on the one hand of at least one pair of opposed flaps attached to the sole and on the other hand of a vamp covering said flaps and the entire front portion of the foot, said flaps comprising means for holding said resilient flexion-counteracting member.

The flaps are tightened around the foot by means of suitable tightening means, consisting for example of a traction cable attached to the end of one flap and passing over the other flap.

In order to obtain a satisfactory fit of the foot, preferably two pairs of flaps, each tightened by separate tightening means so as to provide a two-point tightening system, are provided. When cables are used, the two cables may be tensioned by means of a common, single lever.

It is unnecessary that the flaps surround the foot completely, since the fluid-tightness is provided by the cover. It is thus possible to imprat a relatively high degree of freedom to said flaps so as to facilitate the tightening thereof.

According to a specific form of embodiment of the invention, the vamp is an integral part of the front quarter of the shaft and the projection formed on the front quarter is arrow-headed and adapted to be hooked under tension to the vamp. This arrangement is advantageous in that it permits not only of molding the front quarter of the shaft and the vamp in the open condition, that is, with the arrow-head released from the cover, but also of anchoring the arrow-head to the vamp during the assembly, by bending the front quarter of the shaft.

According to another form of embodiment of the invention, the upper transverse edge of the vamp is covered by the shaft and the resilient member is disposed between the vamp and the shaft, and engages both a projection of said vamp and a projection of said shaft.

Another advantageous feature of the ski boot according to the present invention is that all means for fastening a bearing plate to the shell or to the inner slipper can be dispensed with.

THE DRAWINGS

FIG. 1 is perspective view of a first form of embodiment of the improved ski boot of the present invention.

FIG. 2 is an exploded view of the ski boot of FIG. 1, without the back quarter of the upper, FIG. 3 is another view of the front quarter of the shaft and of the vamp of the same ski boot, FIG. 4 is a detail view, in fragmentary section, of the vamp, FIG. 5 is a perspective view of a closed boot according to a second form of embodiment of this invention, FIG. 6 is an exploded view of the shell of the boot of FIG. 5, without the upper portion of the shaft, FIG. 7 is a vertical and longitudinal section of the boot shell of FIG. 5, without the back portion of the shaft, FIG. 8 is another perspective view of a boot according to a third form of embodiment of the invention, and FIG. 9 is a fragmentary and exploded view of the boot shown in FIG. 8.

DESCRIPTION OF THE PREFERRED EMBODIMENTS

Figure 1:
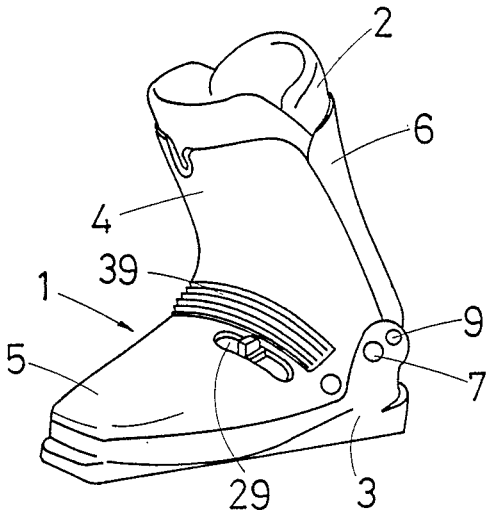

The ski boot shown in FIG. 1 consists essentially of a shell 1 of synthetic, semi-rigid material, and of an inner slipper 2 of flexible and soft material.

The shell 1 consists of three sections: a bottom portion 3 comprising the sole and an upper consisting of a front quarter 4 formed integrally with a foot-covering vamp 5 and a backquarter 6. The front quarter 4 of the shaft is pivotally connected to the bottom portion 3 of the shell at two laterally opposed points, 9, 8, and the back quarter 6 of the shaft is pivotally connected to the bottom portion 3 at two laterally opposed points 7, 10 disposed at a relatively short distance at the rear of points 7 and 8, respectively. The back quarter 6 of the shaft can be tilted backwards about its pivot points 9, 10 when it is desired to take off the boot.

Figure 2:
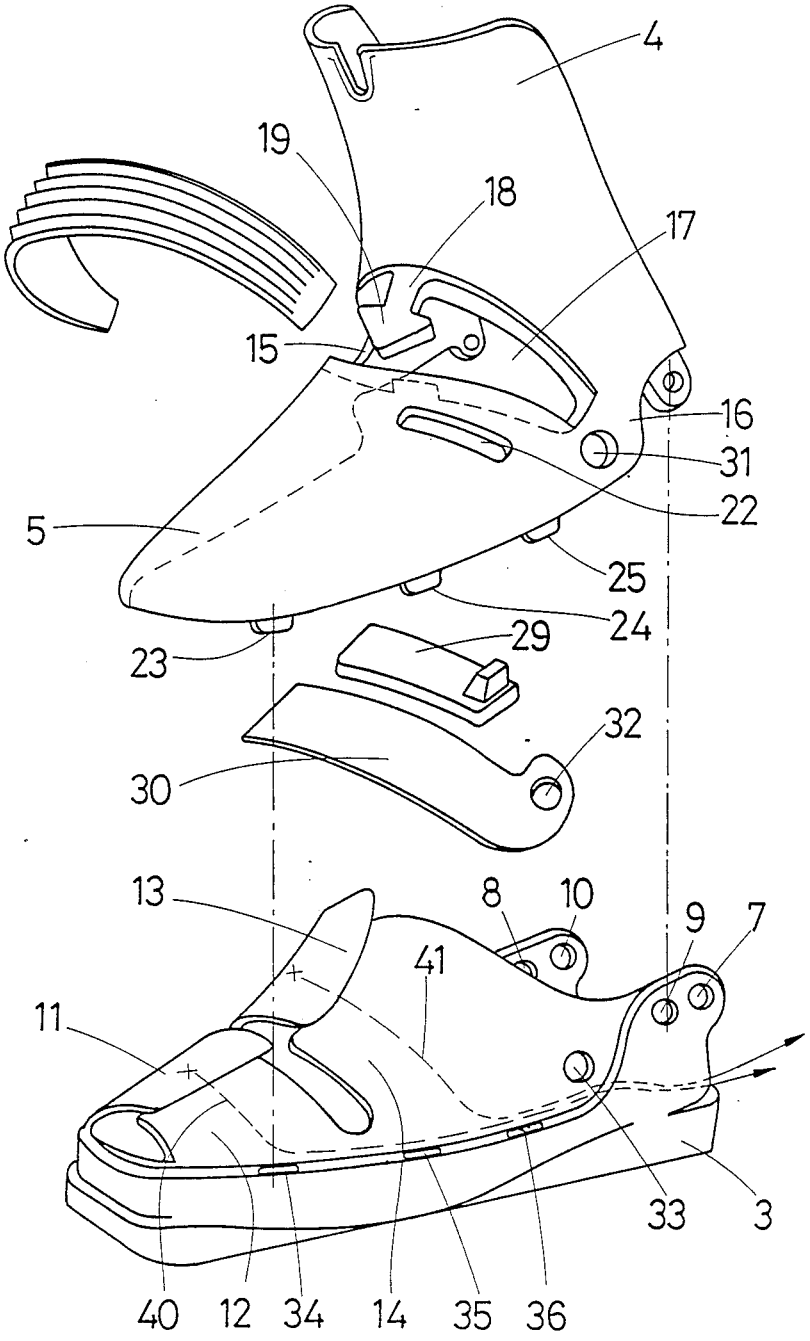

The bottom portion 3 of the shell, which comprises the sole, is provided with two pairs of flaps 11, 12 and 13, 14 formed integrally with the sole, during the manufacture thereof. These flaps 11, 12 and 13, 14 are relatively thin to preserve their flexibility. As shown in FIG. 2, the bottom portion 3 of the shell has the general appearance of a kind of sandal having a relatively thick sole.

Figure 3:
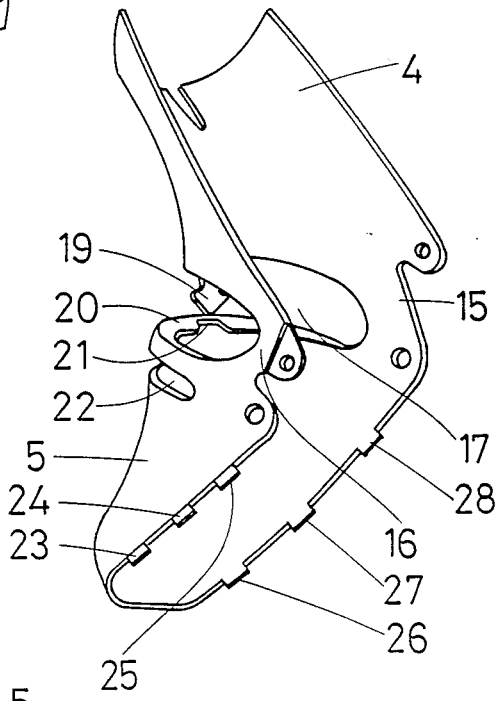

The front quarter 4 of the shaft and the vamp 5 constitute a single integral unit and are interconnected by a pair of lateral bridges 15, 16 between which a relatively wide notch 17 extending over the instep is provided, thus permitting the bending of the front quarter 4 of the shaft in the forward direction with respect to the vamp 5. When stripped from the mold, the front quarter 4 and the vamp 5 have the relative positions shown in FIGS. 2 and 3. The notch 17 is wide open. The lower edge of the front quarter 4 which limits the notch 17 comprises an axial projection 18 having edge of notch 17, which is formed on the vamp 5, has an inturned central lip 20 comprising a passage 21 of a width substantially inferior to the major dimension of the arrow-head 19.

The vamp 5 further comprises a rectangular aperture or elongated slot 22 and its lower peripheral edge is provided with a plurality of depending studs 23, 24, 25, 26, 27, 28.

Figure 4:
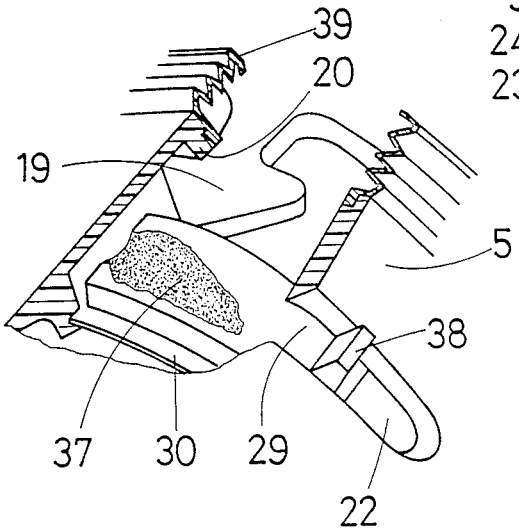

When assembling the main component elements 3, 4, 5 of the shell, a resilient strap 29 and a tongue 30 adapted to support the resilient strap 29 are inserted between the pair of flaps 13, 14 and the vamp 5. the vamp 5, tongue 30 and bottom portion 3 of the shell are assembled by means of fastening members (not shown) extending through corresponding holes 31, 32 and 33, respectively, formed therein. The studs 23–28 engage positioning holes 34, 35, 36 formed through the bottom portion 3 of the shell. Then, the front quarter 4 of the shaft is inclined forwardly so as to to engage the projection 18 laterally through the passage 21. The head 19 of this projection 18 will thus hook from behind the inturned lip 20, as shown in FIG. 4. In this position, the tip of the arrow-head 19 will bear against the strap 29. This strap 29 is not homogeneous. Thus, it comprises an inner portion 37 of relatively very compressible material and variable width. Under these conditions, the strap 29 has a rate of compressibility which varies in the transverse direction, when engaged by the arrow-head 19. This strap 29 comprises a lateral projection 38 engaging the elongated slot 22 to permit the movements of the strap 29 across the boot, so that the point whereat the arrow-head 19 bears against the strap 29 and consequently the bending stress of the boot shaft can be modified at will. The notch 17 is closed by a bellows 39 having its edges welded to the edges of said notch.

In this example, the pairs or flaps 11–14 can be tightened around the skier's foot by means of a pair of cables 40, 41 having each one end fastened to one end of the flaps 11 and 13, respectively, these cables being guided on the opposite flap and extending towards the heel of the ski boot with the assistance of suitable guide means consisting for instance of a bicycle brake cable sheath. The other ends of the cables 40, 41 are fastened to a common tensioning device or to separate tensioning devices (not shown), secured to the rear surface of the back quarter 6 of the shaft, in a manner known per se.

On the other hand, the boot shaft is closed either by a conventional buckle (not shown) or by a collar or a cable adapted to be actuated by the same tensioning device as the device actuating the cables 40 and 41.

It will thus be seen that due to the provision of the pair of flaps 11, 12 and 13, 14 the skier's foot will be held under the best possible conditions not only by the proper fitting of the skier's heel in the heel cavity but also by the possibility of adapting the inner volume of the boot to the volume of the foot.

According to a modified form of embodiment of the ski boot, the vamp and the front quarter of the boot shaft may also consist of two elements pivotally and laterally interconnected. On the other hand, the pivot points 7 and 9 of the front and rear quarters of the shaft could be merged into a single pivot point.

Besides, the bellows 39 could be fastened by snap-action or detent means, or any other suitable auxiliary mechanical means such as rivets.

Figure 5:
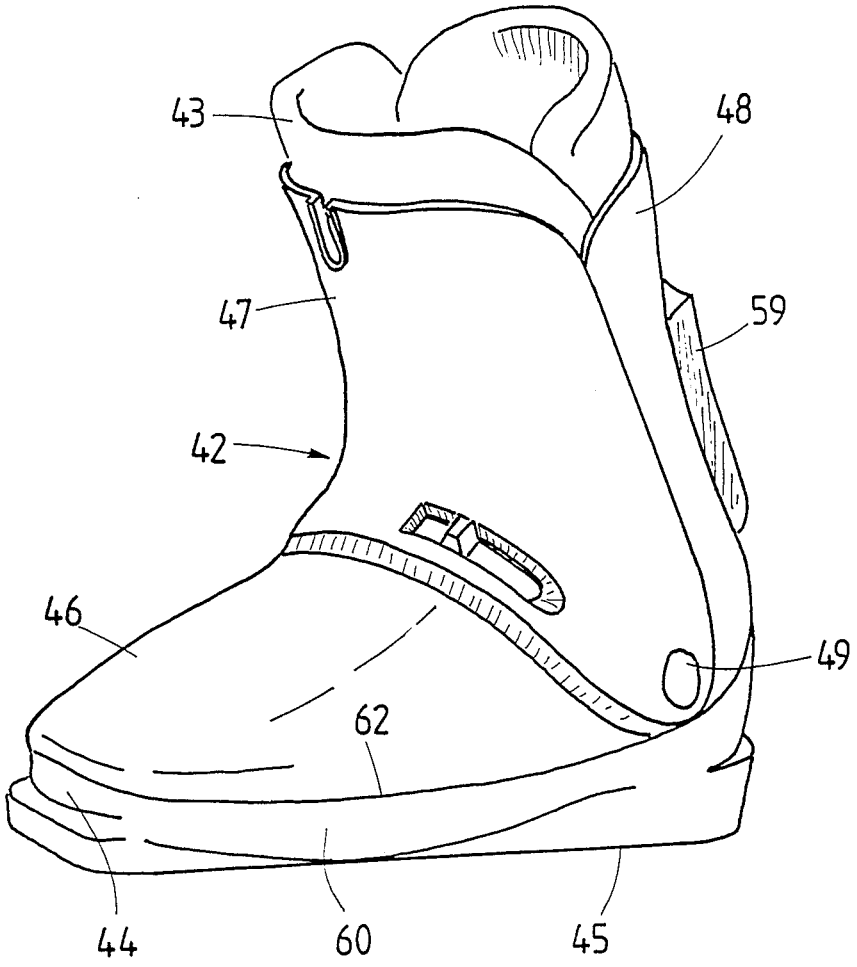
Figure 6:
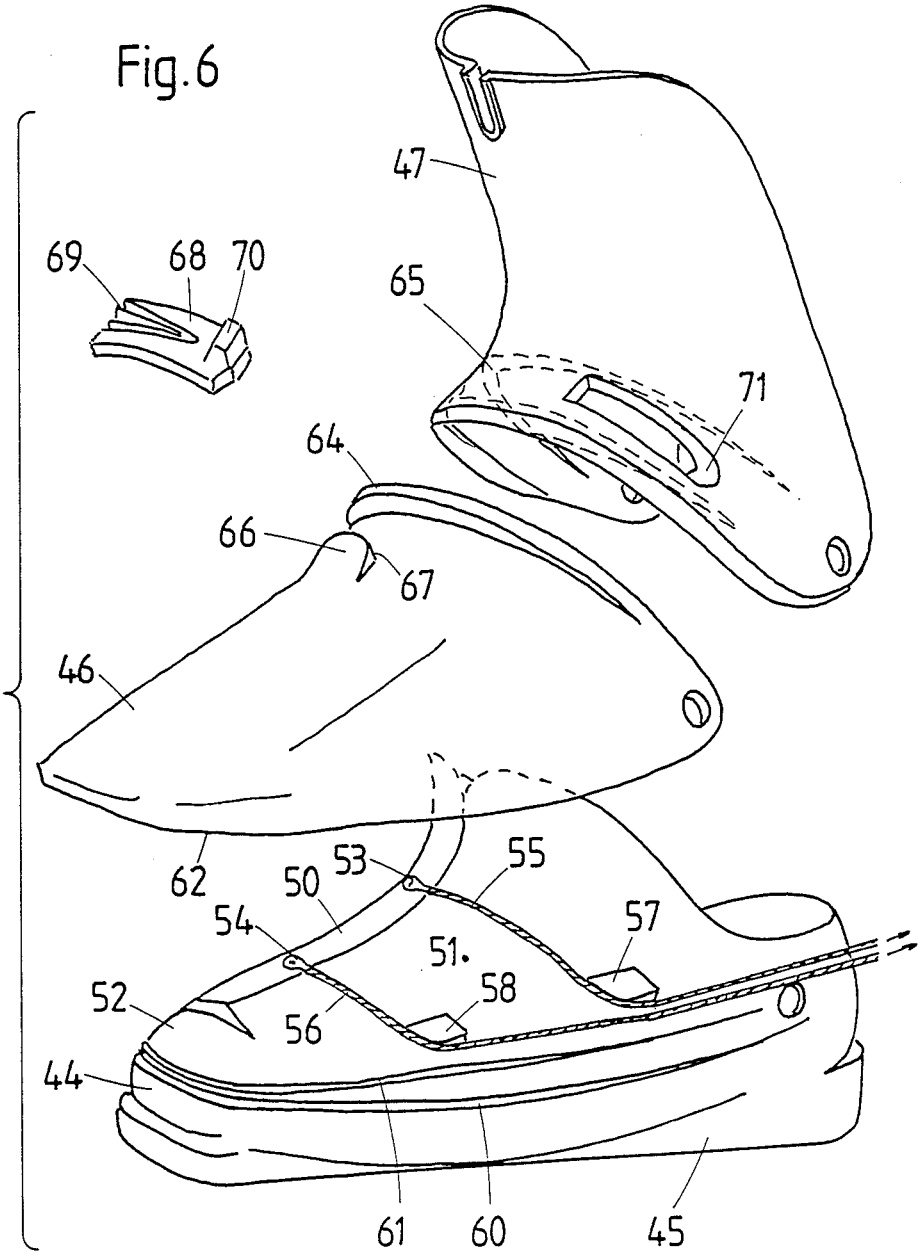
Figure 7:
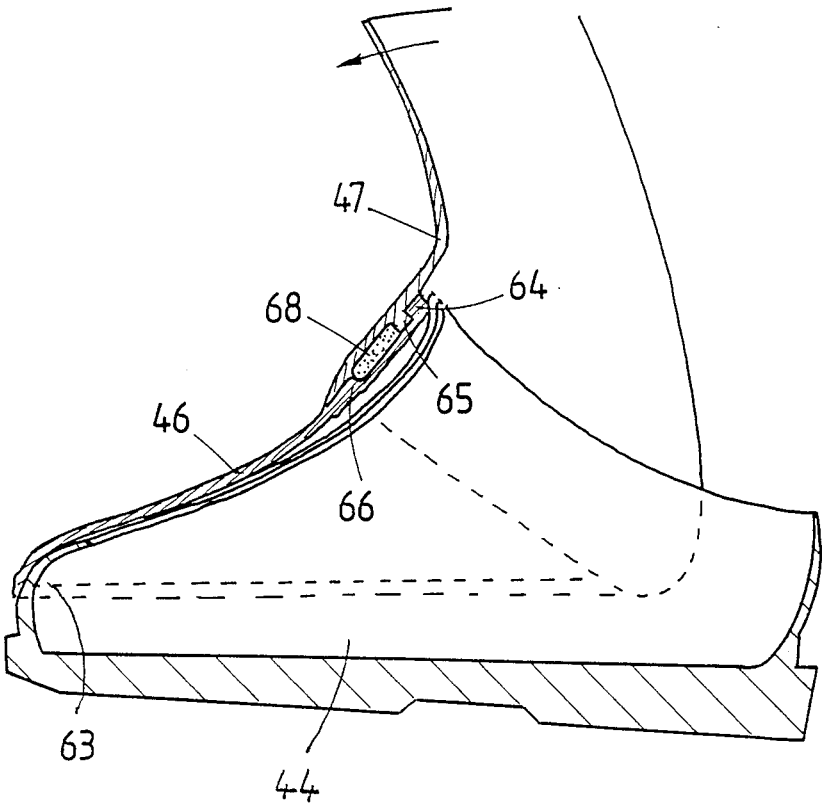

The modified form of embodiment of the ski boot according to the present invention shown in FIGS. 5–7 of the drawings comprises a shell 42 of semi-rigid synthetic material and an inner slipper 43 of flexible and soft material.

The shell 42 comprises four portions, namely: a bottom portion 44 incorporating the sole 45 and surrounding the heel, a vamp 46 covering the skier's foot and a shaft consisting of a front quarter 47 and of a back quarter 48. These quarters 47, 48 are pivotally connected to the bottom portion 44 by means of a pair of opposite rivets such as the rivet 49 shown in FIG. 5. These rivets are also used for connecting the vamp 46. Furthermore, they permit the backward tilting movement of the back quarter of shaft 48 to open the boot when the latter is put on from the rear or heel end. The pivotal connection between the front quarter 47 and the other component elements of the boot permit a certain degree of forward inclination of the shaft, as will be explained presently.

The lower portion 44 has the general appearance of an ordinary low-upper walking shoe and comprises a pair of slightly overlapping lateral flaps 50, 51 formed integrally with the sole 45. The toe end 52 of the boot is closed. Both flaps 50 and 51 extend up to a relatively high level on the instep, so as to cover it. Fastened to two points 53 and 54 of flap 50 are the ends of two cables 55 and 56 passing around curved guide members 57 and 58, respectively, disposed at the base of flap 51 and acting as return means to cables 55, 56 having their opposite ends connected to the rear of a tensioning device 59 mounted on the back quarter 48 of the shaft and adapted to tighten the flaps 50 and 51. These flaps 50 and 51 may be relatively thin and flexible, so as to fit well to the foot configuration. The guide members 57 and 58 enable a suitable transverse tractive effort to be exerted on flap 50.

The lower portion 44 comprises on the major portion of its periphery, above the sole 45, a bearing surface 60 and, above this bearing surface 60, a bead 61 for fastening the vamp 46. This vamp 46 encompasses completely the front of the footgear, that is, the flaps 50 and 51 and the toe-box 52. The lower edge 62 of vamp 46 is provided with an inturned lip 63 (FIG. 7) permitting the snap-fitting engagement of the vamp under the bead 61 of the lower portion 44, while the lower edge 62 of the vamp is level with the bearing surface 60. The upper transverse edge of vamp 46 comprises a projecting ledge 64 engageable under an inner rib 65 of the front quarter 47 of the shaft, so that the projecting ledge 64 of the vamp will act as a stop limiting the backward pivotal movement of the front quarter 47 of the shaft (FIG. 7). Ahead of the ledge 64 the vamp 46 comprises a relatively narrow projection 66 having a rounded surface 67, perpendicular to the vamp surface, which faces the projecting ledge 64, and an front surface inclined at a moderate angle to the vamp surface. The lower edge of the front portion 47 of the shaft covers this narrow projection 66 and bears against the vamp 46. Between the projection 66 and the inner rib 65 of the front quarter 47 of the shaft, a strap 68 of a material having a variable elasticity under a transverse compression stress is fitted. In this case the variable elasticity is obtained by providing a V-shaped bellows 69 interconnecting the edges of a notch of corresponding configuration formed longitudinally in said strap 68. Furthermore, this strap 68 comprises a projection 70 enabling the strap to be moved laterally. This projection 70 may be reached and actuated through a notch 71 formed in the front portion 47 of the shaft. When the boot shaft is bent forwards, the strap 68 is compressed between the projection 66 of the vamp and the rib 65 of the front quarter 47 of the shaft. When the position of said strap 68 is changed, the resistance of the boot shaft to flexion stress is modified. When the projection 70 is in its endmost position close to the centre line of the boot, the flexion elasticity is zero, and when the projection 70 is in another end position closer to the rivet 49, the strap 68 does not register with the projection 66 and no resistance to compressive efforts is offered by said strap 68. Of course, the variable compression of the strap may be obtained through different means, if desired, notably by resorting to a combination of two materials having different degrees of rigidity.

The shaft of this boot is closed by means (not shown) consisting for example of a conventional buckle, a strap of a known type, or a cable system actuated by the tensioning device 59 acting on cables 55 and 56, as described for example in various recent documents.

Due to the provision of flaps 50 and 51 and of vamp 46, the ski boot of the present invention has the external appearance of a boot having a rigid shell constituting its lower portion, with all the advantages deriving from this type of boot from the point of view of fluid tightness and mechanical strength, whereas the inner space of the boot has a variable volume and can be tightened like a conventional walking shoe.

In a modified form of embodiment, the back quarter 48 of the shaft may if desired by fulcrumed at two points other than rivets 49. Additional rivets may be provided for fastening the vamp 46 to the bottom portion or sole, in addition to or in lieu of the bead 61.

Figure 8:
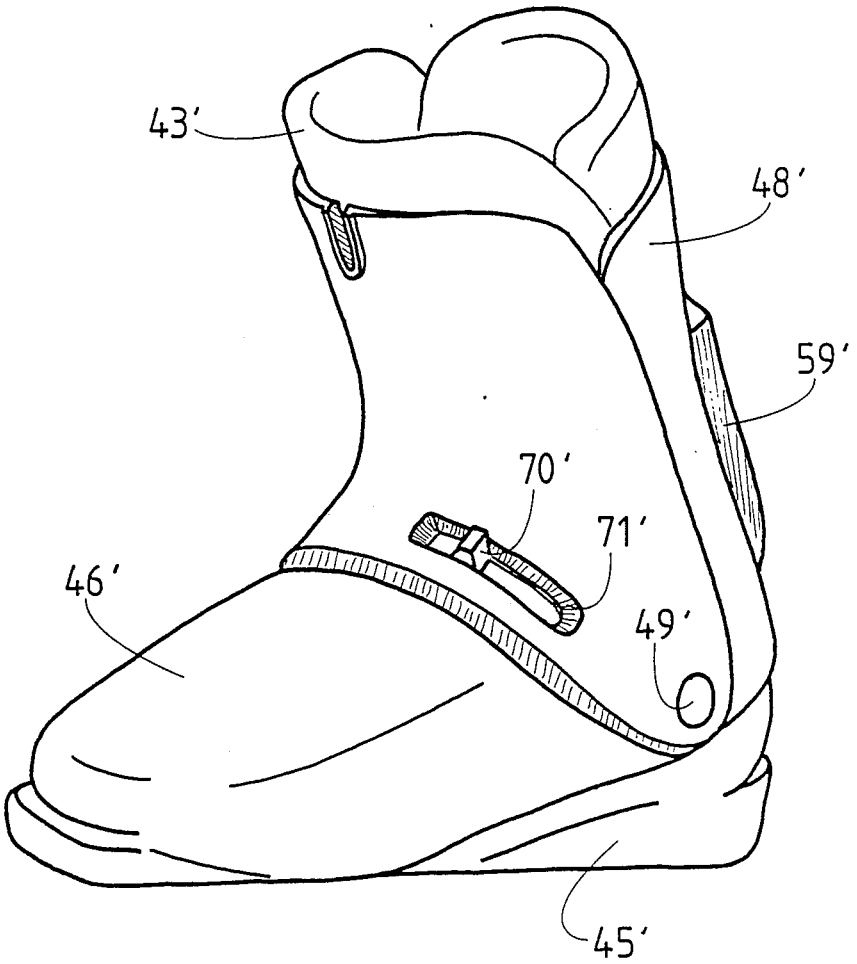
Figure 9:
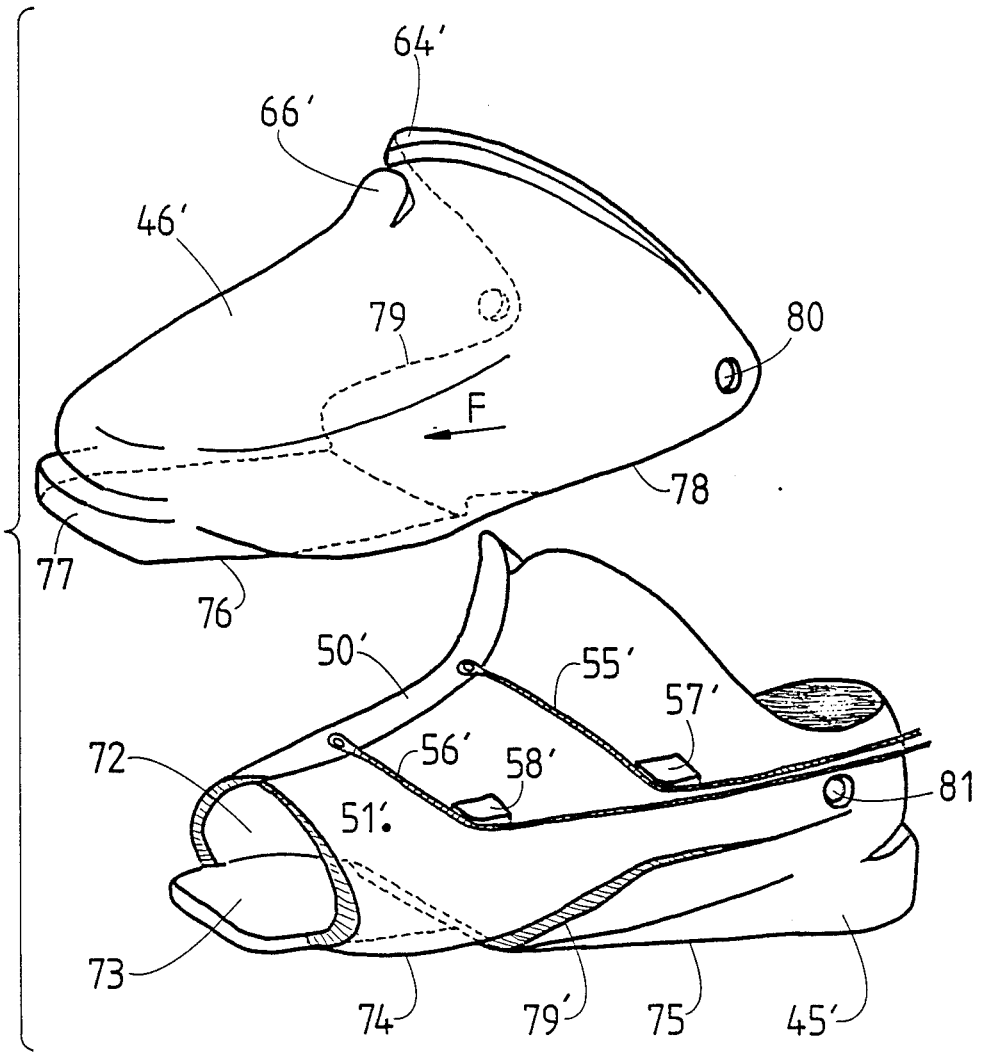

A third form of embodiment of the invention is illustrated in FIGS. 8 and 9 of the drawings. In this ski boot, many features already described with reference to the first and second forms of embodiment are incorporated and to avoid a redundant description the component elements of this form of embodiment which correspond to the component elements of the preceding forms of embodiment are designated by the same reference numerals to which the sign "prime" (') is added. Therefore, only the features of this third form of embodiment which differ from those of the preceding examples will be described hereinafter. This difference lies mainly in the manner in which the front portion of the boot is made, more particularly the lower portion of the shell comprising the sole 45' and the means for fastening the vamp 46'. As shown more particularly in FIG. 9, the toe portion of the sole 45' with its two side flaps 50' and 51' is truncated in a substantially vertical transverse plane 72 with respect to the longitudinal centre line of the boot, except for a horizontal forwardly-extending tongue 73 substantially level with the sole 45'. The sole proper covers only approximately the two thirds of the boot length, starting from the heel, the remaining portion 74 constituting a kind of upswept sleeve above the plane 75 of the sole. The vamp 46', on the other hand, constitutes a kind of cap or sheath into which the lower portion of shell 45' is fitted in the direction of the arrow F. The vamp 46' comprises under these conditions on the one hand the front portion 76 of the sole, which eventually constitutes the extension of the sole portion 75, and on the other hand, the toe end of the ski boot 77. The horizontal tongue 73 engages a recess formed by molding in the end portion of vamp 46' at the level of the toe end 77. The side edges 78 and 79 of vamp 46' are thus caused to register with an oblique bearing surface 79' and also with a corresponding, identical bearing surface formed on the other side of the lower portion of shell 45'. Furthermore, the vamp 46' and the lower portion of shell 45' are fastened in the preceding examples by means of rivets 49' extending through holes 80 and 81 formed for this purpose on either side of the boot. The rigidity of this fastening means could of course be further improved by providing another pair of separate rivets in addition to those permitting the pivotal movements of the boot shaft. This third form of embodiment is characterized by several advantageous features with respect to the first and second forms of embodiment. Thus, the cohesion, assembly and fluid-tightness of the boot are improved considerably, since the entire front portion of the boot consists of a one-piece, fluid-tight member. On the other hand, the flaps 50' and 51' are definitely independent of each other, so that a more accurate and efficient tightening of the front portion of the skier's foot can be obtained. Moreover, the molding and stripping of the lower portion of the shell 45' are facilitated.

Finally, the cable guide means 57 and 58 could be replaced by guide grooves.

What is claimed as new is:

1. A ski boot comprising a shell of semi-rigid synthetic material comprising a lower portion including a sole surrounding the skier's foot and heel, a foot-covering portion, and a shaft including a front quarter and a back quarter fulcrumed to said lower portion, and a resilient member counteracting the forward flexion of said front quarter, and foot holding means disposed inside said shell, wherein the foot-covering portion of said shell includes at least one pair of opposed lateral flexible flaps connected to the sole and a fluid-tight vamp covering said flaps as well as substantially the entire lower portion of the fore part of the foot and having means for retaining said resilient member.

2. The ski boot of claim 1, wherein said vamp is connected to the front quarter of the shaft, means being also provided which enable said shaft to bend in relation to said vamp, the lower edge of said shaft being provided with a projection bearing against said resilient member fitted under said vamp.

3. The ski boot of claim 2, wherein said vamp is formed integrally with, and connected to, the front quarter of the shaft by means of a pair of lateral bridges between which a notch is formed which constitutes said means permitting the bending of said shaft in relation to said vamp.

4. The ski boot of claim 3, wherein said projection is provided with a head shaped to permit the hooking under tension of said projection to said vamp.

5. The ski boot of claim 4, wherein said head of said projection is an arrow-head and the edge of said vamp which is adjacent to said notch provides a passage of width inferior to that of said arrow-headed projection, whereby said head can be hooked behind the edges of said passage by deflecting the front quarter of said shaft.

6. The ski boot of claim 5, wherein said resilient member comprises a compression-stressed strap of which the modulus of elasticity varies from one point to another along the strap, said strap being movable in the transverse direction.

7. The ski boot of claim 2, wherein foot tightening means are provided which includes at least one traction cable having one end fastened to one of the flaps of said pair of flaps and passing over the other flap so as to tighten said flaps on the foot.

8. The ski boot of claim 1, wherein the upper transverse edge of said vamp is covered by a lower portion of the front quarter of the shaft, said flexion-counteracting resilient member being located between said vamp and the shaft portion covering said vamp, and between an outer projection of said vamp and an inner projection of said shaft, said resilient member being compressed between said projections during the forward flexion of said shaft.

9. The ski boot of claim 8, wherein said upper transverse edge of said vamp comprises a projecting ledge against which the front quarter of the shaft normally bears in its inoperative, unstressed position, due to the presence of said resilient member.

10. The ski boot of claim 9, wherein said resilient member comprises a compression-stressed strap of which the modulus of elasticity varies from one point to another along the strap, said strap being movable in the transverse direction.

11. The ski boot of claim 8, wherein said foot holding means comprises at least one cable having one end fastened to one of said flaps and the other end attached to a tensioning device, said cable passing over return means disposed at the base of the opposite flap.

12. The ski boot of claim 8, which comprises a single pair of flaps, wherein the lower portion of the boot, with the flaps and the sole, but without the vamp, has the general appearance of a low-upper, closed toe-end shoe.

13. The ski boot of claim 8, wherein said vamp has an inwardly bent lower edge whereby said vamp can be hooked to a bead formed on said lower portion.

14. The ski boot of claim 13, wherein said lower portion comprising the sole and the flaps, the vamp and the front quarter of the shaft, are assembled by means of a pair of rivets acting at the same time as a means permitting the pivotal movements of the front quarter of the shaft.

15. The ski boot of claim 14, wherein said back quarter of the shaft is also fulcrumed on said rivets.

16. The ski boot of claim 8, wherein said vamp has a cap-shaped end constituting the toe-box of the boot and the toe-end of the sole, said capshaped end having fitted therein the toe end of the sole and of said flaps.

17. The ski boot of claim 16, wherein said toe end of the sole which comprises said flaps is truncated so as to impart a relative freedom to said flaps.

* * * * *